US005707142A

United States Patent [19]

Gordin

[11] Patent Number: 5,707,142

[45] Date of Patent: Jan. 13, 1998

[54] LIGHTING FIXTURE

[75] Inventor: Myron K. Gordin, Oskaloosa, Iowa

[73] Assignee: Musco Corporation, Oskaloosa, Iowa

[21] Appl. No.: 671,832

[22] Filed: Oct. 9, 1996

[51] Int. Cl.[6] ..... F21V 7/00

[52] U.S. Cl. ..... 362/346

[58] Field of Search ..... 362/346, 347, 362/350

[56] References Cited

U.S. PATENT DOCUMENTS

| | | | |
|---|---|---|---|
| 1,267,882 | 5/1918 | McFaddin | 362/346 |
| 2,113,777 | 4/1938 | Waterbury | 362/346 |
| 4,293,901 | 10/1981 | Hernandez | 362/346 |
| 5,075,828 | 12/1991 | Gordin et al. | 362/297 |
| 5,582,479 | 12/1996 | Thomas et al. | 362/346 |

OTHER PUBLICATIONS

GE Ligthing Systems, Ultra☆Sport™Floodlight Product Guide; 12 Brochure, OLP-2518A; General Electric Company, Hendersonville, NC 28793; May 1996(5M)GELS, Date Unknoun.

*Primary Examiner*—Carroll B. Dority

*Attorney, Agent, or Firm*— Zarley,McKee,Thomte, Voorhees,& Sease

[57] ABSTRACT

An improved lighting fixture of the type having a horizontally positioned unjacketed arc lamp in a two piece reflector having a front bowl-shaped reflector that issues a relatively narrow beam and a rear dish-shaped reflector positioned behind the arc tube that issues a wider beam spread. Although such a fixture inherently has some glare and spill control by exploiting the horizontal, transverse positioning of the arc tube across the reflector combination, the invention improves on glare and spill control from this fixture by re-orienting the rear reflector so that it is tipped slightly downward. The upper part of the beam from the rear reflector is therefore moved so that it does not cause glare or spill off of the target area, and also it increases efficiency of the fixture by placing more usable light on the target area. Optionally a visor can be used to further control glare and spill.

26 Claims, 3 Drawing Sheets

LIGHTING FIXTURE

BACKGROUND OF THE INVENTION

1. Field of the Invention

The present invention relates to high intensity lighting fixtures, and in particular, to an apparatus and method for reducing glare and spill light from a lighting fixture having an unjacketed arc tube horizontally positioned within a bowl shaped reflector, where the reflector has a front portion and a rear portion comprising a relatively small saucer-shaped member that is separate and removable from the front portion of the reflector.

2. Problems in the Art

One type of lighting fixture that is widely known in the art is the type described above. The light source is an arc tube that is placed transverse to the central axis of the bowl-shaped reflector. The arc tube is normally positioned horizontally during operation. One example of such a fixture is the Ultra Sport™ flood light available from General Electric.

The Ultra Sport™ flood light does use a two piece reflector. The main part of the reflector, what is called the front reflector by General Electric, consists essentially of the side wall of the bowl-shape. The other part, called the rear reflector by General Electric, consists essentially of the bottom of the bowl.

In the Ultra Sport™ flood light, the front reflector is made of spun aluminum, an economical way to manufacture the shapes required of such high intensity lighting fixtures. Even though spun aluminum can be made to have a fairly high reflective surface, it generally can not exceed around 85% reflectivity. This means that the aluminum absorbs some of the light incident upon it. The rear reflector is made of glass covered by a highly reflective, specular material (approximately 95% reflectivity) to create almost a mirror-like reflecting surface, but concave in nature.

By referring to parts of FIGS. 1 and 2 of the drawings, the general structure of a fixture like the Ultra Sport™ flood light can be seen. The Ultra Sport™ flood light consists of bowl-shaped reflector 12 mounted on main housing ring 15, which is adjustably connected to mounting trunnion 14 at pivots 17 to allow the fixture to be pivoted about a horizontal axis extending through pivots 17 on opposite sides of trunnion 14. An enclosure 16 mounted to trunnion 14 includes ballasts and other electrical components. A lens frame 18 holds a tempered glass lens (⅛ inch or 3.2 mm thick) in place over the front opening to reflector 12.

An arc tube 20 comprises the light source for fixture 10. It is held horizontally and transversely to the center axis of reflector of reflector 12 by left and right connectors 22 and 24. A front reflector portion 26 the bowl shaped reflector 12 surrounds some of arc tube 20 and extends outwardly therefrom. Rear reflector 28 (see FIG. 2) is a relative small, saucer or dish shaped piece that is positioned behind arc tube 20. It mates into an opening in front reflector 26 so that when assembled, front and rear reflectors 26 and 28 approximate a unitary smooth shape.

In the case of the Ultra Sport™ flood light, front reflector 26 (20 inch or 508 mm) is made of high quality specular or semi-specular aluminum and is manufactured by a spinning process, such as is well known in the art. Rear reflector 28, on the other hand, is made of a press molded glass material that includes a thin film coating having mirror-like finish and 95% reflectivity.

FIG. 2 also shows that the Ultra Sport™ flood light includes top, middle and bottom cut-off skirts 32, 34, and 36 which are placed just inside the lens.

FIGS. 3 and 4 show another aspect of the Ultra Sport™ flood light. A non-corrosive high pressure die-cast aluminum rear reflector housing or rear access door 38 is secured to the main housing ring 15 at the back of fixture 10. Four ears 40 on main housing ring 15 correspond with four ears 42 on access door 38, and screws 44 are used to fasten them together. A hinge 46 allows access door 38 to be pivoted open (see FIG. 4). This rear access allows relamping of arc tube 20, and maintenance or replacement of internal components.

FIGS. 5 and 6 show how rear reflector 28 is mounted inside rear access door 38. What are called standoffs 54 A, B, and C (see FIG. 6 for a specific example) are equally spaced around the interior side of door 38. Each standoff 54 has a main portion 56 and a secondary portion 58. As shown in FIG. 6, dish-shaped rear reflector 28 is supported by secondary portions 58 of standoffs 54A–C, then securing plates 60 are secured to the top of main portions 56 of standoffs 54A–C by securing screws 62 to essentially lock rear reflector 28 into place on the interior side of access door 38.

It is to be understood that each standoff 54A–C is intentionally the same height (at both main and secondary portions) so that rear reflector 28 will be symmetrical about an axis 13 through its center and through the center of front reflector 26. In this manner, rear reflector 28 functions as a part of overall symmetrical reflector 12, where all parts of front and rear reflectors 26 and 28 of reflector 12 are symmetrical about that axis 13.

Although the Ultra Sport™ flood light is advertised as a glare and spill light control fixture, a problem still exists with this type of fixture, however. The relatively short distance between arc tube 20 and rear reflector 28 influences the beam spread of rear reflector 28. Its beam spread tends to be larger than that of front reflector 26, which is a relatively farther distance away from arc tube 20. Therefore, in the Ultra Sport™ flood light, for example, the beam spread of rear reflector 28 is on the order of 30 degrees in the vertical plane, whereas the beam spread of front reflector 26 varies but can be, for example, between 18 and 30 degrees in the vertical plane. This results in light from rear reflector 28 spreading wider than light from front reflector 26, which in turn can produce glare and spill light.

Fixtures of these types are usually suspended from elevating structures such as light poles or building roof beams or the like. They are generally aimed downwardly, for example, between 15 and 45 degrees below horizontal towards a target area. Although a majority of light from fixture 10 comes from back reflector 28, the amount of light coming from rear reflector 28 will spread wider than that of the front reflector, and therefore, even when the fixture is aimed downward between 15 and 45 degrees, light from rear reflector 28 will project farther because of its wider beam.

Examples abound as to why this produces glare and spill, as is well known in the art. The wider beam of rear reflector 28 can cause light to spill outside a target, such as an athletic field, and onto spectators, or even nearby roadways, houses, or buildings. It can also cause glare in the eyes of those that view the fixtures. Spill light is not an efficient use of light because it means some light is falling outside the target. If put on the target, more light is available. Alternatively, one could use less fixtures to illuminate the target at the same intensity level. This can actually translate in the need for less energy and/or fewer lighting fixtures, poles, electrical hardware, labor, etc., any of which could result in significant savings for the end user of the lights.

The symmetrical nature of front and rear reflectors 26 and 28 to the axis through the center of them results in this problem. It is therefore a primary object of the this invention to provide an improvement to lighting fixtures of the above-discussed type which solves or diminishes the problems or deficiencies of the state of the art.

It is a further object of the present invention to provide an improvement as above-described which:

Reduces spill and glare light from such fixtures.

Is relatively low cost and non-complex.

Continues to utilize existing structure and components of the fixture with relatively minor modifications to reach the advantageous results.

Is durable and long-lasting.

These and other objects, features, and advantages of the invention will become more apparent with reference to the accompanying specification and claims.

SUMMARY OF THE INVENTION

The invention includes an apparatus and method for reducing glare and spill light from a fixture having a two piece reflector, a light source positioned along a central axis of the reflector and both pieces of the reflector being symmetrical about that axis. The first piece of the reflector physically comprises a majority of the reflector and is symmetrical in nature, consisting of all but what is directly in back of the light source. The second piece of the reflector covers the area directly in back of the light source. The first piece creates a narrower symmetrical beam spread than the second piece. The method according to the invention includes repositioning the second piece of the reflector relative to the light source and the axis to adjust its beam spread so that when in operating position, spill light and glare are reduced, minimized, or eliminated. Generally, this involves modifying the structure that supports the second piece of the reflector in a symmetrical relationship in the fixture to a configuration where the second piece is tipped slightly downward to move light that otherwise would travel outside the beam spread of the first piece of the reflector and off-site of the target area, and move that light into the target area. Optionally, blocking and/or redirecting light that otherwise would travel outside the target space could also be used to reduce glare and spill.

The apparatus according to the invention includes a fixture of the type described above including mounting structure for the second piece of the reflector. The mounting structure orients the second piece of the reflector so that it is not symmetrical to the central axis of the reflector. Optionally, a visor can be added to the top portion of the reflector.

DETAILED DESCRIPTION OF THE PREFERRED EMBODIMENT

Figure 1:
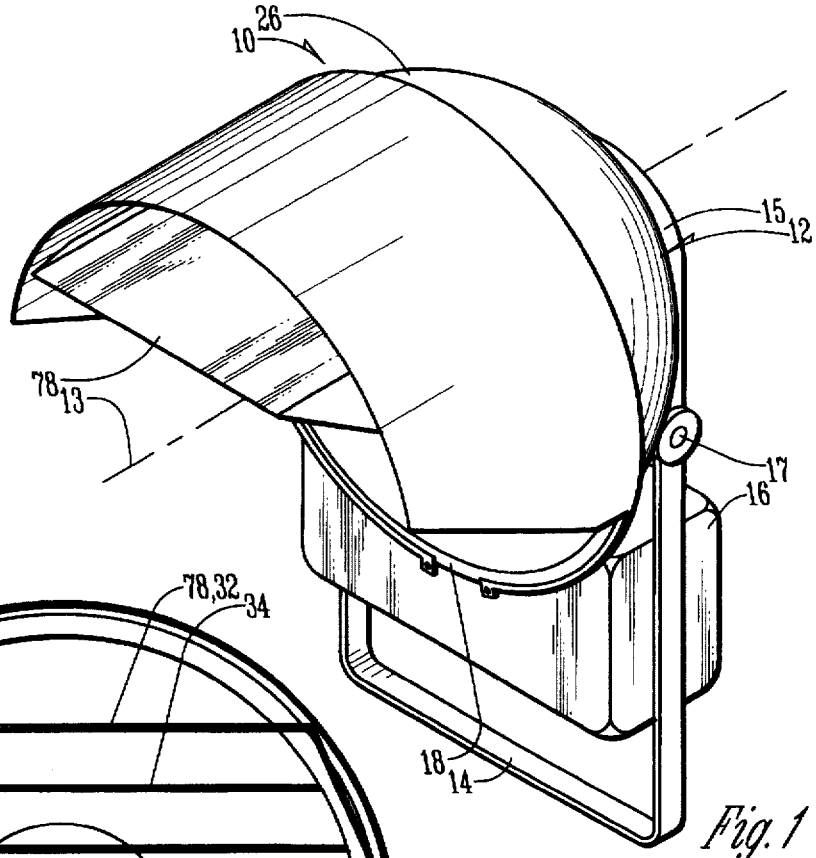
FIG. 1 is a perspective view of a lighting fixture according to a preferred embodiment of the invention.

To gain a better understanding of the invention, a preferred embodiment will now be described in detail. Frequent reference will be taken to the drawings, which are identified and summarized immediately above. Reference numerals are used to indicate certain parts and locations in the drawings. The same reference numerals will indicate the same parts and locations throughout the drawings unless otherwise stated.

FIG. 1 illustrates a fixture like an Ultra Sport™ flood light available from General Electric and which has been described above. It is to be understood, however, that fixtures having similar structure are likewise relevant to the invention, and the invention is not limited to the Ultra Sport™ flood light. FIGS. 1–5 show the basic symmetrical bowl shape of reflector 12 and the position of arc tube 20 (for example a Sylvania 2000 watt metal halide unjacketed arc tube) along a central axis 13, as well as the symmetrical nature of front and rear reflector portions 26 and 28 about that axis 13. It is to be understood that the precise location of arc tube 20 to axis 13 is about ¼ inch below axis 13 because the arc stream in arc tube 20 during operation bows up, such as is known in the art, and placing the body of arc tube 20 slightly below axis 13 aligns the arc stream with axis 13.

Figure 6:
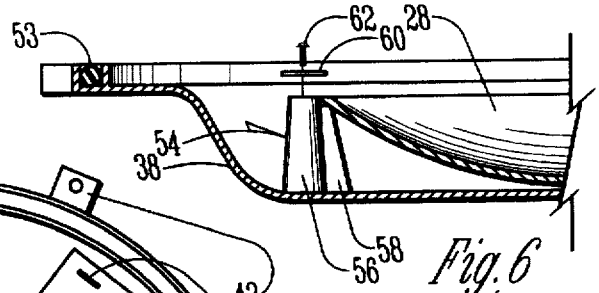
Fig. 6 (PRIOR ART)
FIG. 6 is a partial sectional view of the conventional way in which the rear reflector portion is mounted to the access door.
Figure 5:
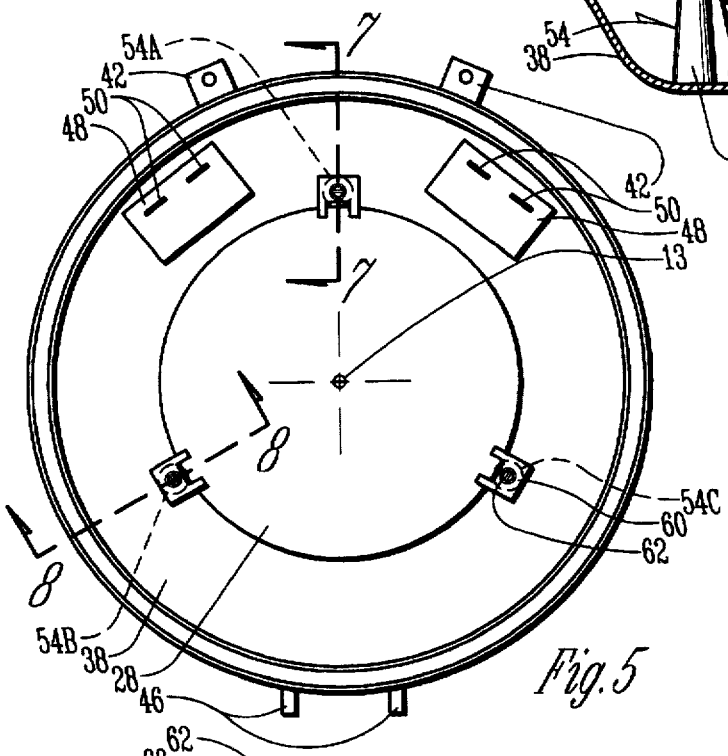
FIG. 5 is a isolated enlarged front elevational view of the interior side of the access door of FIG. 4 showing the position of a dish shaped rear reflector portion mounted to the interior side.

FIG. 6 illustrates that the Ultra Sport™ flood light secures rear reflector portion 28 in its symmetrical position by the use of the three standoffs 54A–C, all of which are the same size and configuration to center and hold rear reflector portion 28 symmetrical to axis 13.

It is to be noted that rear reflector portion 28 fits snugly within rear access door 38. There is little room between its top perimeter edge and the top plane of door 38, as shown in FIG. 6, or between the bottom of rear reflector portion 28 and the interior bottom of door 38.

Figure 7:
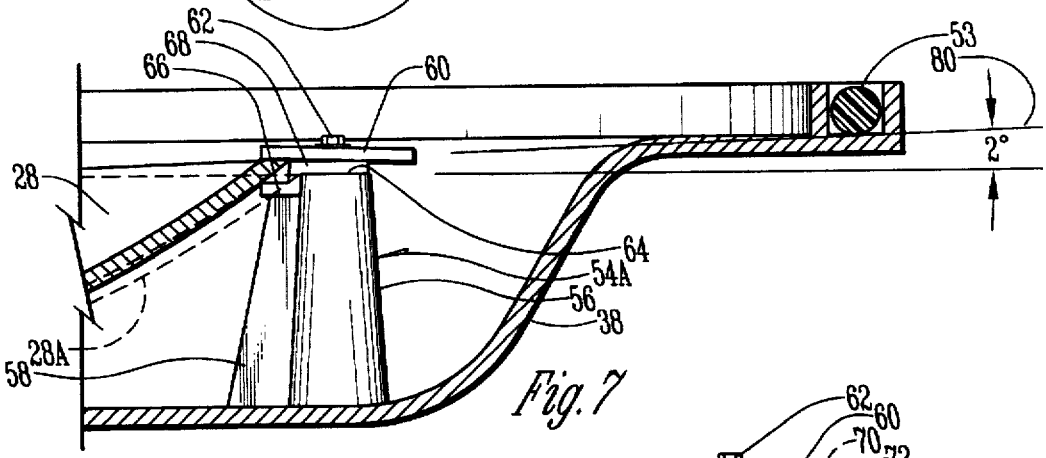
FIG. 7 is an enlarged partial sectional view taken along line 7—7 of FIG. 5, showing the mounting of one location of the rear reflector portion according to the preferred embodiment of the invention.
Figure 8:
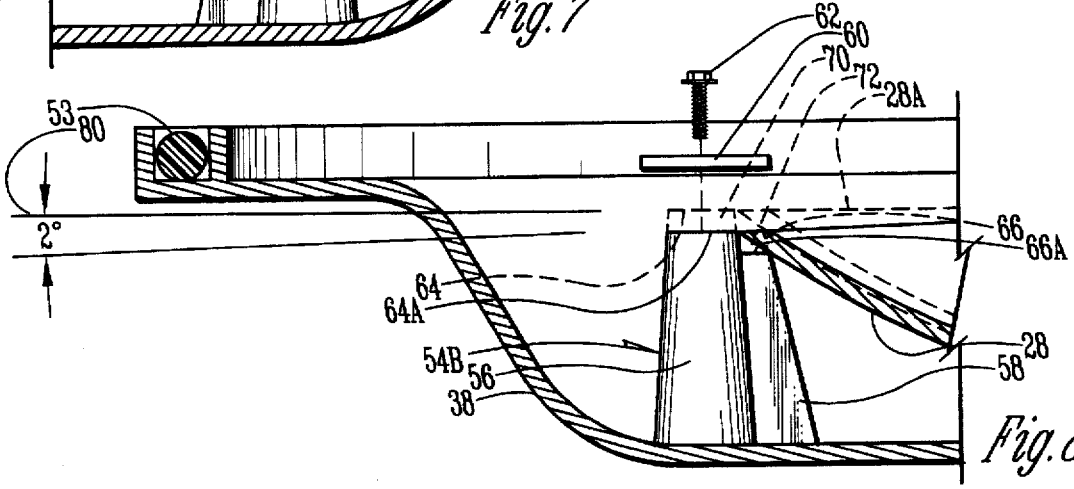
FIG. 8 is an enlarged partial sectional view taken along line 8—8 of FIG. 5, showing the mounting of another location of the rear reflector portion according to the preferred embodiment of the invention.

FIGS. 7 and 8 illustrate how rear reflector portion 28 is repositioned or tipped. By referring also to FIG. 5, what will be called top standoff 54A is built-up by added a conforming spacer that mates with the top surfaces 64 and 66 of main and secondary portions 56 and 58 of stand off 54A. Securing plate 60 and screw 62 are again used to clamp that location of rear reflector portion 28 in place. Spacer 68 basically simulates the function of standoff 54A, but raises the mounting height of rear reflector portion 28 at that location.

FIG. 8 illustrates that standoffs 54B and C (only standoff 54B is shown here, but 54C would be identical) have been modified by removing portions 70 and 72 from the tops of main and secondary portions 56 and 58 of standoffs 54B and C. This can be done by machining or by other means within the skill of those skilled in the art. The dashed lines in FIG.

8 show the conventional position of rear reflector portion 38 with the normal standoffs in a Ultra Sport™ flood light. The solid lines show that at the locations of standoffs 54B and C, rear reflector portion 28 would be lowered.

Thus collectively, rear reflector portion 28 would be tipped slightly downward. As previously discussed, the beam created by rear reflector portion 28 would likewise be tipped downward relative to the beam created by front reflector portion 26, which would not change by these modifications.

The modifications are relatively simple, quick and economical. They are also durable and utilize mostly existing parts and components of the fixture. However, the effect on glare and spill can be substantial. For example, it can cut glare and spill approximately in half at some aiming angles and situations.

For example, in one embodiment, spacer 68 was ⅛ inch thick and removed portion 70 and 72 were 0.105 inch thick (approximately ⅛" thick). In the Ultra Sport™ flood light, this resulted in a 2 degrees downward shift in rear reflector portion 28, which in turn results in a 4 degrees downward shift in the beam from rear reflector portion 28. This shift, however, can produce a significant shift in spill and glare light at certain angles, and can result in gains of usable light onto a target area of on the order of 5 percent. Therefore, advantages of the tipping of rear reflector portion 28 can be advantageous with respect to reduction of glare and spill light, as well as actual increased amounts of light available to be used to illuminate the target.

The Ultra Sport™ flood light produces light in the following manner. Front reflector 26 can be made in various configurations and beam spreads. According to literature published by its manufacturer, it produces about a 21 to 54 degree beam spread (corresponding with NEMA numbers 2 through 4). Its aluminum configuration produces the most concentrated portion of the beam, and therefore the maximum candle power point for the fixture is substantially determined by front reflector 26 and the beam it produces.

Rear reflector 28 can be made in various configurations, including various beam spreads. In one style compatible with front reflector 26, rear reflector 28 produces approximately a 24 degree beam spread. The amount of light coming off rear reflector 28 and its beam spread do not dominate the maximum candle power point of the fixture. This allows, therefore, the invention to modify the aiming of the beam from rear reflector 28, to shift it down, without substantially modifying the maximum candlepower point of the fixture.

The included preferred embodiment is given by way of example only, and not by way of limitation to the invention, which is solely described by the claims herein. Variations obvious to one skilled in the art will be included within the invention defined by the claims.

For example, tipping of the rear reflector portion 28 in the Ultra Sport™ flood light is mechanically limited to about 2 degrees by the closeness of it to the boundaries of other parts of the fixture. However, the invention is not limited to 2 degrees. A typical range of tipping would be from just slightly (perhaps on the order of only a fraction of a degree) up to around 5 degrees. Values outside that range are possible however.

Figure 2:
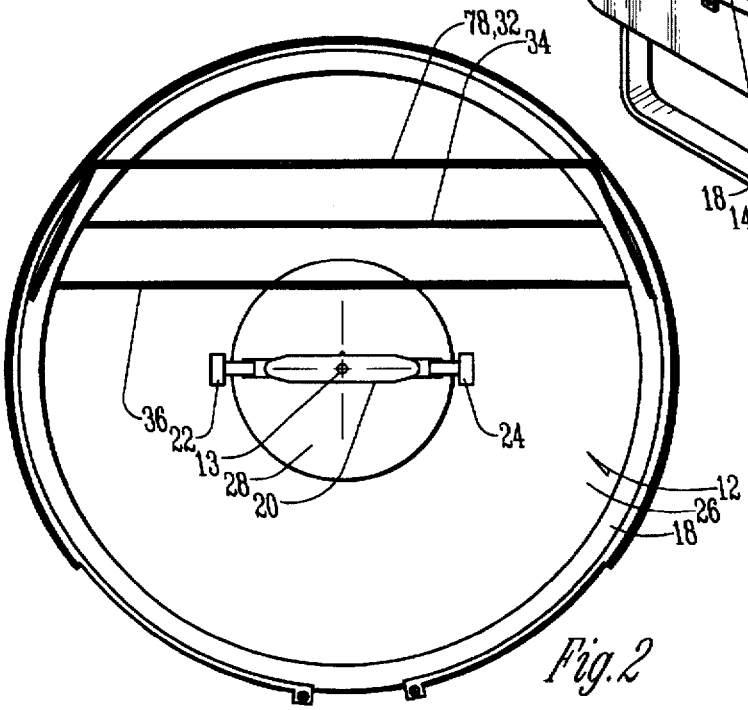
FIG. 2 is a front elevational view of the fixture of FIG. 1.
Figure 3:
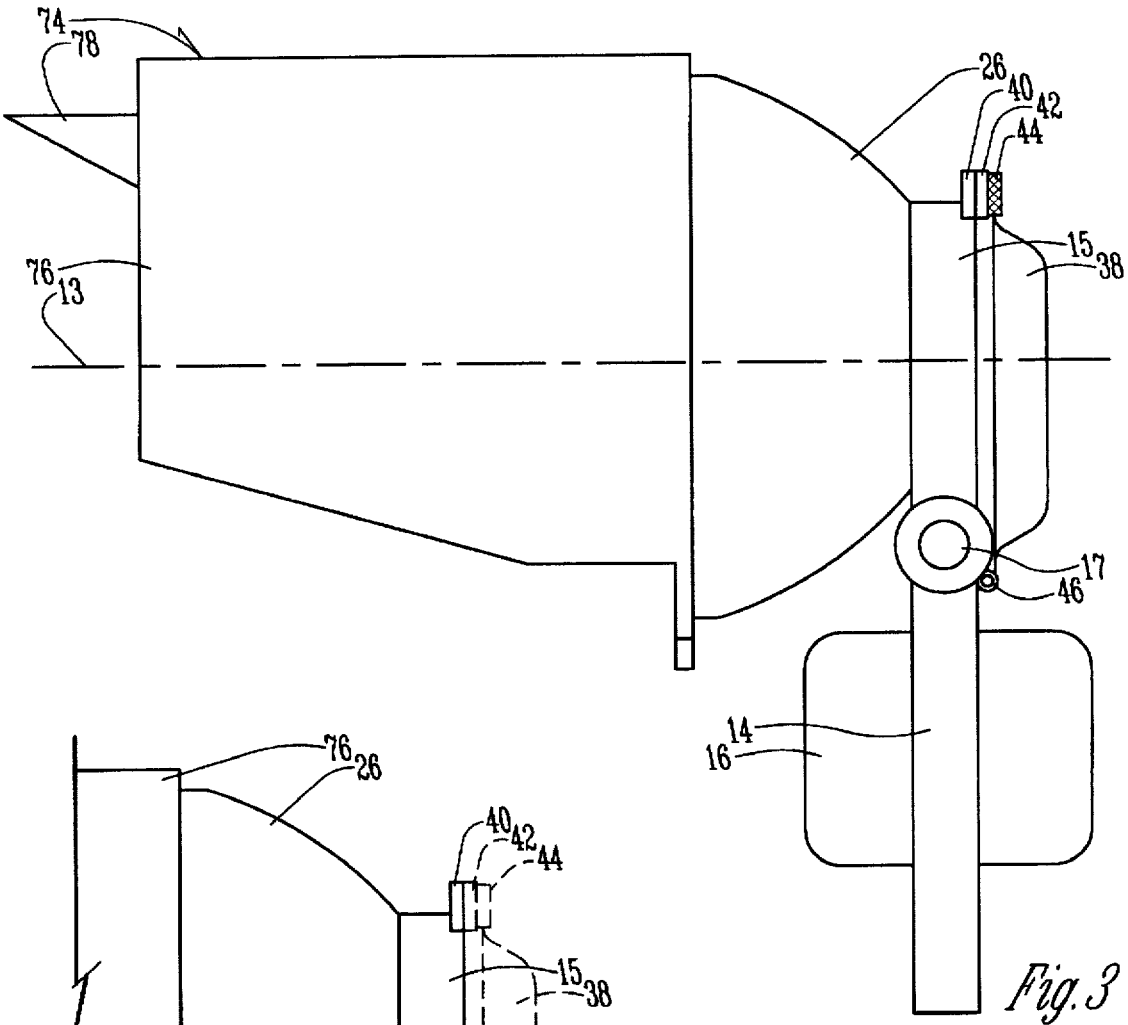
FIG. 3 is a side elevational view of the fixture of FIG. 1.
Figure 4:
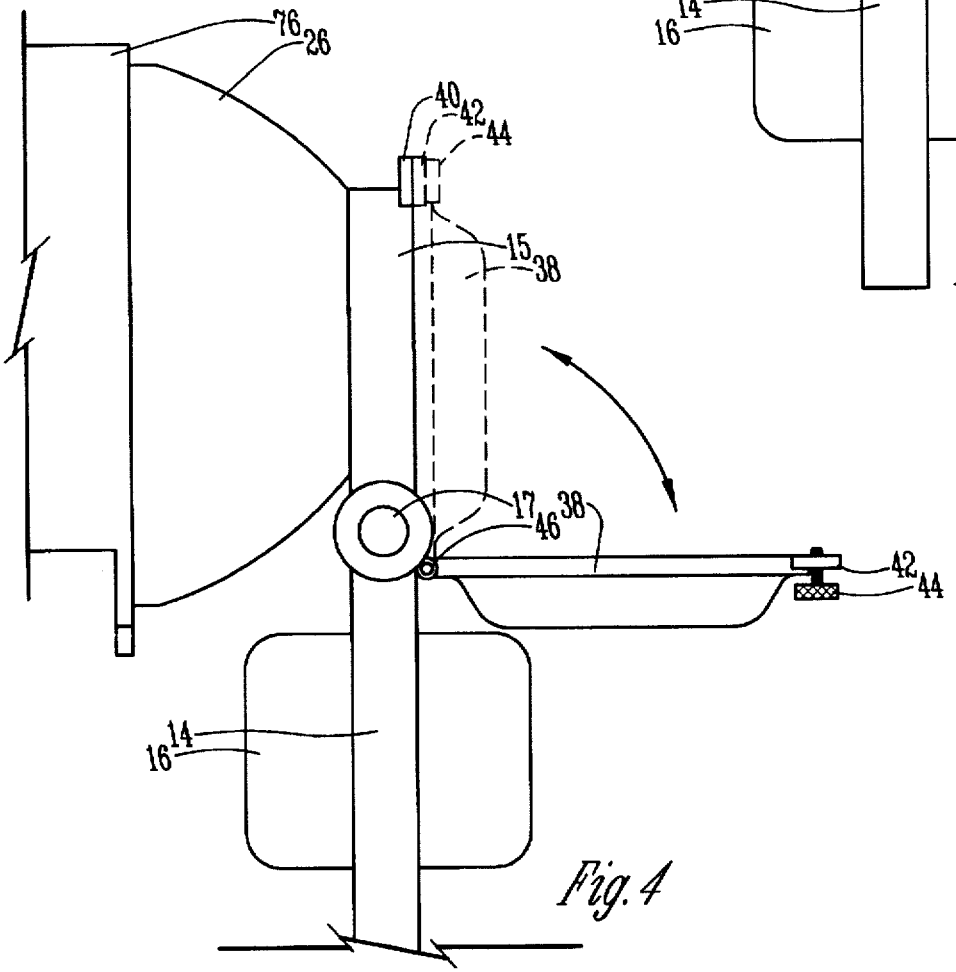
FIG. 4 is a partial view similar to FIG. 3, but shows a rear access door of the fixture moved to an open position.

FIGS. 1, 2, and 3 illustrate that a visor 74 could optionally be added to fixture 10. In this embodiment, visor 74 includes a main portion 76 that wraps around approximately 270 degrees of the front of fixture 10 at its margin of attachment to reflector 26, but note that it tapers upwardly to its distal edge. A second portion 78 is positioned within and extends somewhat additionally outward of main portion 76, as shown.

Figure 9:
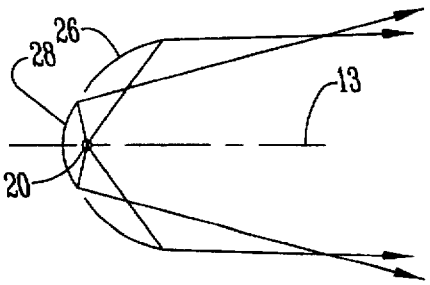
FIG. 9 is a schematic side elevational view of the vertical beam spread from the existing lighting fixture.
Figure 10:
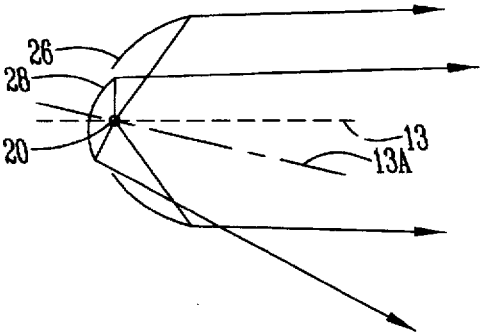
FIG. 10 is similar to FIG. 9, but shows the vertical beam spread after modification of the existing lighting fixture according to the present invention.

FIGS. 9 and 10 diagrammatically illustrate the operation of fixture 10 before (FIG. 9) and after (FIG. 10) modification according to the invention. In FIG. 9, beams from rear reflector 28 and front reflector 26 are symmetrical about axis 13. The top part of the beam from rear reflector 28 passes outside the upper part of the beam from front reflector 26. This creates spill and glare.

FIG. 10 shows that with the tipping of rear reflector 28 downward, and the addition of visor 74, the top portion of the beam from rear reflector 28 does not pass above the upper margin of the beam from front reflector 26, or at least does not do so as much, and visor 74 (FIG. 1)ensures that any such light impacting it will be blocked from traveling upward and outward.

Visor 74 cab be like that disclosed in commonly owned U.S. Pat. No. 5,075,828 to Gordin, issued Dec. 24, 1991 at FIG. 24A. Although some efficiency is lost because of the use of visor 74, the tipping of back reflector portion 28 approximately offsets that loss, so that coupled with its glare and spill control, it is advantageous.

The internal cutoff skirts 34 located within the lens, in combination with visor 74 and the tipping of back reflector portion 28 combine to accomplish glare and spill control for fixture 10. The tipping downward directly addresses the primary area of concern with the conventional fixture of the type of the Ultra Sport™ floodlight, the generally 15 degrees above the maximum candlepower location of the fixture. Fixture 10, configured according to the invention, is especially advantageous for shallower aiming angles (such as between 15 and 25 degrees below horizontal) that usually accompany longer distances to the target area or shorter poles or other elevating structure for the fixtures.

What is claimed:

1. A high intensity lighting fixture comprising:

a fixture frame;

a front reflector mounted to the fixture frame and having a surface of revolution and a central axis;

a light source mounted to the fixture frame and elongated along an axis which is transverse to the central axis;

a rear reflector mounted to the fixture frame and positioned behind the light source and along the central axis;

the rear reflector being tipped relative to the central axis.

2. The fixture of claim 1 wherein the front reflector is bowl shaped with an opening in the back.

3. The fixture of claim 2 wherein the rear reflector fits within the opening in the back of the front reflector.

4. The fixture of claim 1 wherein the light source is an arc tube.

5. The fixture of claim 4 wherein the arc tube is unjacketed.

6. The fixture of claim 4 wherein the art tube is positioned horizontally when in use.

7. The fixture of claim 4 wherein the arc tube is several inches in length along its axis.

8. The fixture of claim 1 wherein the rear reflector is dish shaped, spaced apart from the light source, but closer to the light source than to the front reflector.

9. The fixture of claim 1 wherein the rear reflector has a high reflectivity.

10. The fixture of claim 1 wherein the rear reflector is configured to provide a wider beam spread than the front reflector.

11. The fixture of claim 1 wherein the front reflector is made of spun aluminum.

12. The fixture of claim 1 wherein the rear reflector is tipped in a direction transverse to the axis.

13. The fixture of claim 12 wherein the rear reflector is tipped 0.01 to 5 degrees relative to the central axis.

14. The fixture of claim of claim 13 wherein the rear reflector is tipped approximately 2 degrees.

15. The fixture of claim 1 wherein the rear reflector is tipped so that one margin of the beam spread of the rear reflector comes within an adjacent margin of the beam spread of the front reflector.

16. The fixture of claim 1 further comprising one or more internal cutoff skirts positioned inside a lens across a front opening to the front reflector.

17. The fixture of claim 1 further comprising a visor positioned on and extending forwardly from the front reflector.

18. The fixture of claim 1 further comprising the rear reflector being mounted to a housing of the fixture.

19. The fixture of claim 18 wherein the housing includes a plurality of standoffs extending toward the front of the fixture.

20. The fixture of claim 19 wherein the standoffs have varying heights to hold the rear reflector in a canted position relative to the central axis.

21. A method of improving glare and spill control and efficiency of a lighting fixture of the type having a front reflector having a surface of revolution and a central axis; a light source, elongated along an axis which is transverse to the central axis; and a rear reflector positioned behind the light source and along the central axis comprising: tipping the rear reflector relative to the central axis.

22. The method of claim 21 further comprising placing a cutoff skirt inside the fixture.

23. The method of claim 21 further comprising placing a visor on the fixture.

24. The method of claim 21 wherein the rear reflector is tipped between 0.01 and 5 degrees.

25. The method of claim 21 wherein the rear reflector is tipped downward when in use.

26. An apparatus for improving glare and spill control and efficiency of a lighting fixture of the type having a front reflector having a surface of revolution and a central axis; a light source, elongated along an axis which is transverse to the central axis; and a rear reflector positioned behind the light source and along the central axis, the improvement comprising:

the rear reflector being tipped relative to the central axis.

* * * * *